US008997297B2

(12) United States Patent
Mohr et al.

(10) Patent No.: US 8,997,297 B2
(45) Date of Patent: Apr. 7, 2015

(54) TOOTHBRUSH

(75) Inventors: Juergen Mohr, Idstein (DE); Martin Vitt, Frankfurt (DE); Martin Jay Marotti, Carmel, IN (US); Daniel Jay Monroe, Iowa City, IA (US); Jens Stoerkel, Kronberg (DE)

(73) Assignee: Braun GmbH, Kronberg (DE)

( * ) Notice: Subject to any disclaimer, the term of this patent is extended or adjusted under 35 U.S.C. 154(b) by 0 days.

(21) Appl. No.: 13/300,957

(22) Filed: Nov. 21, 2011

(65) Prior Publication Data

US 2012/0192369 A1 Aug. 2, 2012

Related U.S. Application Data

(60) Provisional application No. 61/416,119, filed on Nov. 22, 2010.

(51) Int. Cl.
*A46B 5/00* (2006.01)
*A46B 5/02* (2006.01)

(52) U.S. Cl.
CPC ..... *A46B 5/02* (2013.01)

(58) Field of Classification Search
USPC ..... 15/106, 111, 143.1, 144.1, 167.1; 606/16; 132/309
See application file for complete search history.

(56) References Cited

U.S. PATENT DOCUMENTS 1,742,596 A * 1/1930 Hoff ..... 15/172
5,339,482 A * 8/1994 Desimone et al. ..... 15/167.1
5,398,369 A 3/1995 Heinzelman et al.
5,630,244 A * 5/1997 Chang ..... 15/167.1
5,864,915 A 2/1999 Ra
5,875,510 A 3/1999 Lamond et al.
5,960,507 A * 10/1999 Dutra et al. ..... 15/105
6,006,126 A 12/1999 Cosman
D419,773 S 2/2000 Beals et al.
6,076,223 A * 6/2000 Dair et al. ..... 15/167.1
6,108,849 A 8/2000 Weihrauch
D440,048 S 4/2001 Beals et al.
6,308,367 B1 10/2001 Beals et al.
D452,615 S 1/2002 Cheong et al.
6,353,958 B2 * 3/2002 Weihrauch ..... 15/167.1
6,397,425 B1 6/2002 Szczech et al.
6,464,920 B1 * 10/2002 Kramer ..... 264/243

(Continued)

FOREIGN PATENT DOCUMENTS

CA 2 238 099 C 4/1999
CA 2 315 348 A1 7/1999

(Continued)

OTHER PUBLICATIONS

U.S. Appl. No. 29/379,490, filed Nov. 19, 2010, Schaefer et al.

*Primary Examiner* — Monica Carter
*Assistant Examiner* — Michael Jennings
(74) *Attorney, Agent, or Firm* — George Henry Leal; James E. Oehlenschlager; Vladimir Vitenberg

(57) ABSTRACT

An oral care implement is described herein. The oral care implement includes a base and a first grip member. The base has a gripping region and an oral engaging region. The base has an aperture extending therethrough. The first grip member at least partially overlays the gripping region of the base and has a plurality of gripping elements. The first grip member also has a at least one opening exposing a guidance element. The guidance element includes a protrusion and a ring surrounding the protrusion.

15 Claims, 9 Drawing Sheets

(56) References Cited

U.S. PATENT DOCUMENTS

| | | | | |
|---|---|---|---|---|
| D471,362 | S | 3/2003 | Moskovich et al. | |
| 6,601,272 | B2 | 8/2003 | Stvartak et al. | |
| D486,649 | S | 2/2004 | Sprosta et al. | |
| 6,786,732 | B2 | 9/2004 | Savill et al. | |
| 6,968,590 | B2 | 11/2005 | Ponzini | |
| 7,047,591 | B2 | 5/2006 | Hohlbein | |
| D531,412 | S | 11/2006 | Wong | |
| 7,146,675 | B2 | 12/2006 | Ansari et al. | |
| 7,241,413 | B2 * | 7/2007 | Pfenniger et al. | 264/263 |
| D549,462 | S | 8/2007 | Blanchard et al. | |
| 7,297,303 | B2 | 11/2007 | Kraemer | |
| 7,383,619 | B2 | 6/2008 | Gross et al. | |
| 7,415,788 | B2 * | 8/2008 | Little et al. | 40/314 |
| 7,458,125 | B2 * | 12/2008 | Hohlbein et al. | 15/143.1 |
| D593,327 | S | 6/2009 | Wong | |
| 7,540,054 | B2 * | 6/2009 | Goldstein | 15/111 |
| 7,707,677 | B2 | 5/2010 | Moskovich et al. | |
| 7,713,461 | B2 * | 5/2010 | Pfenniger et al. | 264/272.21 |
| D621,160 | S | 8/2010 | Ballmaier et al. | |
| 7,845,042 | B2 | 12/2010 | Moskovich et al. | |
| 8,006,342 | B2 * | 8/2011 | Nanda | 15/105 |
| D646,063 | S | 10/2011 | Ballmaier et al. | |
| 8,239,995 | B2 * | 8/2012 | Chenvainu et al. | 15/167.1 |
| 8,307,488 | B2 * | 11/2012 | Pfenniger et al. | 15/22.1 |
| 8,448,284 | B2 * | 5/2013 | Gross et al. | 15/143.1 |
| 8,448,285 | B2 * | 5/2013 | Kayser | 15/167.1 |
| 8,499,397 | B2 * | 8/2013 | Gatzemeyer et al. | 15/22.1 |
| 8,510,893 | B2 * | 8/2013 | Wong et al. | 15/167.1 |
| 8,522,797 | B2 * | 9/2013 | Dickie | 132/322 |
| 8,549,691 | B2 * | 10/2013 | Moskovich et al. | 15/143.1 |
| 2002/0138931 | A1 * | 10/2002 | Davies | 15/167.1 |
| 2004/0010876 | A1 * | 1/2004 | Kraemer | 15/143.1 |
| 2004/0025272 | A1 * | 2/2004 | Stvartak et al. | 15/143.1 |
| 2004/0060138 | A1 * | 4/2004 | Pfenniger et al. | 15/22.1 |
| 2006/0064833 | A1 | 3/2006 | Jacobs | |
| 2006/0118130 | A1 | 6/2006 | Little et al. | |
| 2007/0163064 | A1 * | 7/2007 | Wong et al. | 15/143.1 |
| 2007/0186453 | A1 | 8/2007 | Little et al. | |
| 2007/0199168 | A1 | 8/2007 | Blanchard et al. | |
| 2007/0283518 | A1 | 12/2007 | Blanchard et al. | |
| 2008/0102953 | A1 | 5/2008 | Schultz | |
| 2009/0019650 | A1 * | 1/2009 | Dickie | 15/22.1 |
| 2009/0183331 | A1 | 7/2009 | Gross et al. | |
| 2009/0313778 | A1 * | 12/2009 | Wong et al. | 15/167.1 |
| 2010/0263149 | A1 * | 10/2010 | Ballmaier et al. | 15/167.1 |
| 2011/0035892 | A1 * | 2/2011 | Baier et al. | 15/143.1 |
| 2011/0041271 | A1 * | 2/2011 | Huang | 15/167.1 |
| 2011/0146015 | A1 * | 6/2011 | Moskovich et al. | 15/167.1 |
| 2011/0247158 | A1 * | 10/2011 | Jungnickel et al. | 15/167.1 |
| 2012/0255136 | A1 * | 10/2012 | Jimenez et al. | 15/167.1 |

FOREIGN PATENT DOCUMENTS

| | | | |
|---|---|---|---|
| CA | 2 372 050 | A1 | 11/2000 |
| CN | 2525857 | Y | 12/2002 |
| CN | 2705053 | Y | 6/2005 |
| CN | 200980435 | Y | 11/2007 |
| CN | 201356211 | Y | 2/2009 |
| CN | 201274864 | Y | 7/2009 |
| CN | 201356212 | Y | 12/2009 |
| CN | 201379211 | Y | 1/2010 |
| CN | 201518879 | U | 7/2010 |
| CN | 201541996 | U | 8/2010 |
| DE | 91 04 536.3 | | 7/1991 |
| DE | 195 00 107 | A1 | 7/1996 |
| DE | 297 05 019 | U1 | 7/1997 |
| DE | 10 2005 055 044 | A1 | 5/2007 |
| DE | 10 2006 024 874 | A1 | 11/2007 |
| EP | 0 251 705 | B1 | 9/1990 |
| MX | PA 05002498 | A | 5/2005 |
| WO | WO 2005/122827 | A1 | 12/2005 |
| WO | WO 2007/084647 | A2 | 7/2007 |
| WO | WO 2007/084727 | A1 | 7/2007 |
| WO | WO 2007/084768 | A1 | 7/2007 |

* cited by examiner

TOOTHBRUSH

CROSS REFERENCE

This application claims the benefit of U.S. Provisional Application Ser. No. 61/416,119, filed on Nov. 22, 2010, the contents of which are incorporated herein by reference.

FIELD OF THE INVENTION

This invention relates to a personal hygiene device, specifically a toothbrush either powered or manual.

BACKGROUND OF THE INVENTION

Toothbrushes are widely accepted by consumers as one of the best instruments for preventing tooth decay. Early toothbrushes generally included a handle made of a single component with a plurality of filaments attached thereto. However, with the progression of technology, particularly in the areas of plastics processing, toothbrushes have become more complex. For example, some toothbrushes currently available have a handle which includes multiple plastic materials.

For those toothbrushes having multiple materials in the handle, often an elastomeric material is utilized in the grip portion of the handle. The elastomeric material can provide soft area(s) on the handle for a user to place their thumb and forefinger. Unfortunately, these soft areas are often uniform in nature offering the user little if any tactile differentiation from one location of a particular soft area to another location on the particular soft area.

Often times, a user brushes their teeth either early in the morning and/or later in the evening. At such times, there may be little to no light during brushing. As such, the user can sometimes be left to rely on tactile sensation for proper gripping. Due to the lack of tactile differentiation in a soft area, the user may improperly grip the toothbrush. An improper grip on the toothbrush handle can potentially reduce the maneuverability of the toothbrush without adjustment of the grip on the toothbrush by the user.

As such, there is a necessity for a toothbrush which provides the user with a soft gripping area while also providing a tactile distinction within a particular gripping area which provides a cue as to the proper placement of a user's thumb and/or forefinger.

BRIEF SUMMARY OF THE INVENTION

A toothbrush constructed in accordance with the present invention can provide the user with a soft gripping area while also providing a tactile distinction within a particular gripping area which provides a cue as to the proper placement of the user's thumb and/or fingers.

An oral care implement comprises a base with a gripping region and an oral engaging region. The base has an aperture extending therethrough. The oral care implement further comprises a first grip member at least partially overlying the gripping region of the base and is provided with at least one opening exposing a guidance element, wherein the first grip member comprises a plurality of gripping elements, and wherein the guidance element comprises a protrusion and a ring surrounding the protrusion.

In some embodiments, an oral care implement comprises a base with a gripping region and an oral engaging region. The base has a first aperture and a second aperture, each extending therethrough, and the base further comprises a neck and a head attached to the neck. A first grip member at least partially overlying the gripping region of the base is provided with at least one opening exposing a guidance element, wherein the first grip member comprises a plurality of gripping elements. The guidance element comprises a protrusion and a ring surrounding the protrusion. A second grip member in the gripping region is unitary with the first grip member and is attached to the first grip member through the first aperture. An identification symbol being unitary with the second grip member is attached thereto through the second aperture. A collar surrounding the neck, being unitary with the first grip member is disposed at an angle with respect to a longitudinal axis.

A method of forming an oral care implement comprises the steps of obtaining a base having a first aperture, the base having a front side and a back side. An elastomeric material is injected from the back side through the first apertures to the front side. A first grip member is formed on the front side where the first grip member surrounds a base portion. A collar is formed unitarily with the first grip member, the collar allowing elastomeric material to flow from the front side to the back side.

DETAILED DESCRIPTION OF THE DRAWINGS

A toothbrush constructed in accordance with the present invention can provide to a user a soft gripping area for the thumb and/or for the forefinger while also providing a cue for proper placement of the thumb and/or the forefinger.

Figure 1:
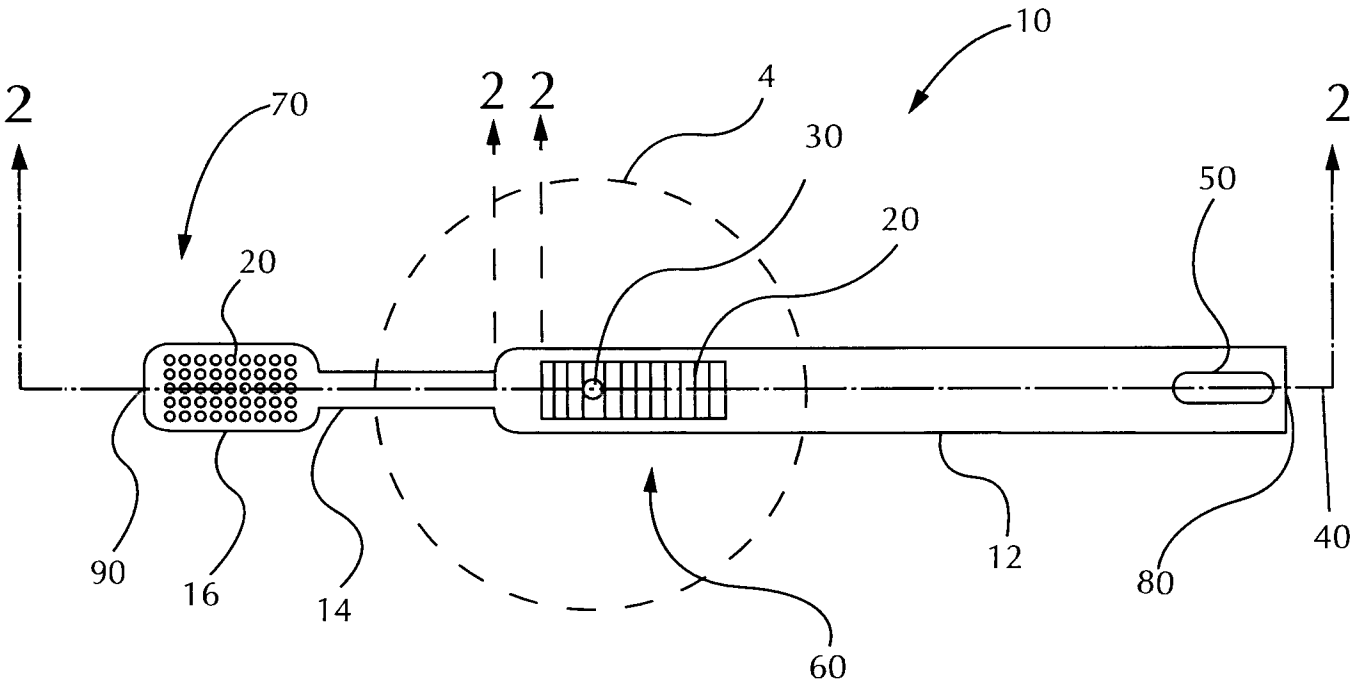
FIG. 1 is a plan view of a toothbrush constructed in accordance with an embodiment of the present invention.

As shown in FIG. 1, an oral care implement, e.g. a toothbrush 10, constructed in accordance with the present invention may comprise a base 210 (shown in FIGS. 2A and 2B) having a gripping region 60 and oral engaging region 70. The gripping region 60 may comprise a portion of the handle 12, a first grip member 20, and a guidance element 30. As shown, the first grip member 20 may comprise an opening which allows the guidance element 30 to form part of a front side surface 260 (shown in FIGS. 2A and 2B). A longitudinal axis 40 runs from a distal end 80 of the toothbrush 10 to a proximal end 90 of the toothbrush 10. The first grip member 20 at least partially overlays the gripping region 60.

While the discussion regarding the materials utilized for the first grip member 20 and the base 210 is provided hereafter, the material utilized for the guidance element 30 can be harder than that of the first grip member 20. The difference in material hardness can provide a tactile cue to a user of the proper thumb and/or forefinger placement during use of the toothbrush 10.

The oral engaging region 70 may comprise a head 16 and a plurality of contact elements 20. A neck 14 extends between the head 16 and the handle 12 thereby connecting the oral engaging region 70 and the griping region 60. The head 16 and/or the neck 14 may be angled with respect to the handle 12. Additionally, the head 16 may comprise an elevated surface 299 (shown in FIGS. 2A and 2B) from which the contact elements 20 extend. The elevated surface is discussed further hereafter with regard to FIGS. 6 and 7.

Additionally, the toothbrush 10 may comprise an identification symbol 50. The identification symbol 50 may provide some visual indication of the type of oral care implement, the maker of the oral care implement, and/or the brand name of the oral care implement. In some embodiments, the identification symbol 50 may comprise a plurality of materials. For example, a hard material may be utilized to form specific alpha numeric characters or other symbols, while a soft material may surround or at least partially surround the alpha numeric characters or other symbols. As another example, a soft material may be utilized to form specific alpha numeric characters or other symbols, while a harder material may surround or at least partially surround the alpha numeric characters or other symbols.

Figure 2A:
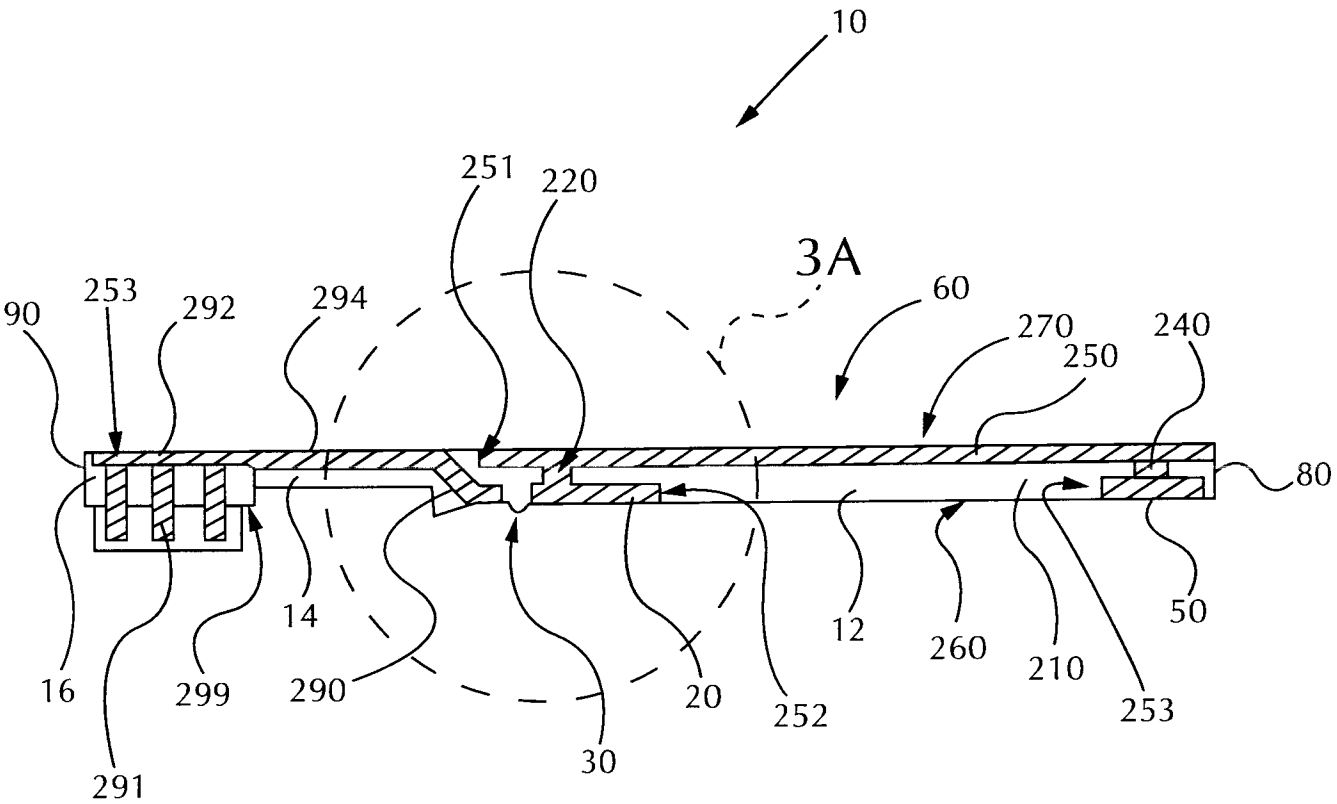
FIG. 2A is a partial cross sectional view of the toothbrush of FIG. 1 along line 2-2.

As shown in FIG. 2A, the oral care implement 10 may comprise a second grip member 250 which forms a portion of a back side facing surface 270. In contrast, the first grip member 20 forms a portion of the front side facing surface 260. As shown, the first grip member 20 may be disposed in a recess 252 in the base 210. Similarly, the second grip member 250 may be disposed in a recess 251 in the base 210. Last, the identification symbol 50 may be disposed in a recess 253 in the base 210 such that the identification symbol 50 is flush with the front side surface 260 of the oral care implement 10. As stated previously, the first grip member 20 may comprise an opening exposing the guidance element 30. As shown, the guidance element 30 may be unitarily formed with the base 210. Additionally, the guidance element 30 may comprise a material which is harder than that of the first grip member 20 in order to provide a tactile cue for a user.

As shown, a collar 290 can surround the neck 14 and may be unitary with the first grip member 20. The collar 290 may be inclined with respect to a lateral axis which is perpendicular to the longitudinal axis 40. An angle of inclination 390 (shown in FIG. 3) can be greater than about 5 degrees, greater than about 10 degrees, greater than about 15 degrees, greater than about 20 degrees, greater than about 30 degrees, and/or less than about 30 degrees, less than about 20 degrees, less than about 15 degrees, less than about 10 degrees, or any range or any number with the degrees stated above. The collar 290 forms a portion of the outer facing surface of the toothbrush 10 and is not shown in cross section in FIG. 2A.

In some embodiments, the toothbrush 10 may further comprise a tongue cleaner 292. As shown, the tongue cleaner 292 may be disposed in a recess 254 on a back side of the head 16.

The tongue cleaner 292 may comprise a plurality of tongue cleaning structures which may be utilized to reduce and the amount of odor causing substances in the oral cavity. Some examples of suitable materials for the tongue cleaner 292 include elastomeric materials; polypropylene, polyethylene, etc; the like, and/or combinations thereof The tongue cleaner 292 may comprise any suitable soft tissue cleansing elements. Some examples of such elements as well as configurations of soft tissues cleansers on a toothbrush are described in U.S. Patent Application Nos. 2006/0010628; 2005/0166344; 2005/0210612; 2006/0195995; 2008/0189888; 2006/0052806; 2004/0255416; 2005/0000049; 2005/0038461; 2004/0134007; 2006/0026784; 20070049956; 2008/0244849; 2005/0000043; 2007/140959; and U.S. Pat. Nos. 5,980,542; 6,402,768; and 6,102,923.

The toothbrush 10 may comprise a plurality of elastomeric elements 291 which may be unitarily formed with the tongue cleaner. The plurality of elastomeric elements 291 may be disposed on the periphery of the head 16. In such a position, the elastomeric elements 291 may be utilized to provide gum massaging during brushing. In some embodiments, the plurality of elastomeric elements 291 may be positioned inboard of the periphery of the head 16, e.g. nearer the longitudinal axis 40 (shown in FIG. 1). In such a position, the plurality of elastomeric elements 291 may provide a polishing function for harder oral cavity surfaces, e.g. enamel.

The plurality of elastomeric elements 291 may be any suitable shape. Some examples of suitable shapes include curved walls, elongated walls, round cross sectioned elements, square cross sectioned elements, triangular cross sectioned elements, polygonal cross sectioned elements, cups, ovals, arcuate structures, e.g. multiple sides, and/or combinations thereof Additionally, depending on the desired function of the elastomeric elements 291, an additive may be provided on or in the element. For example, for polishing, the elastomeric elements 291 may comprise a polishing agent as described in U.S. Pat. No. 6,151,745. As another example, for gum massaging, the elastomeric elements 291 may comprise an antibacterial/antimicrobial composition.

Figure 2B:
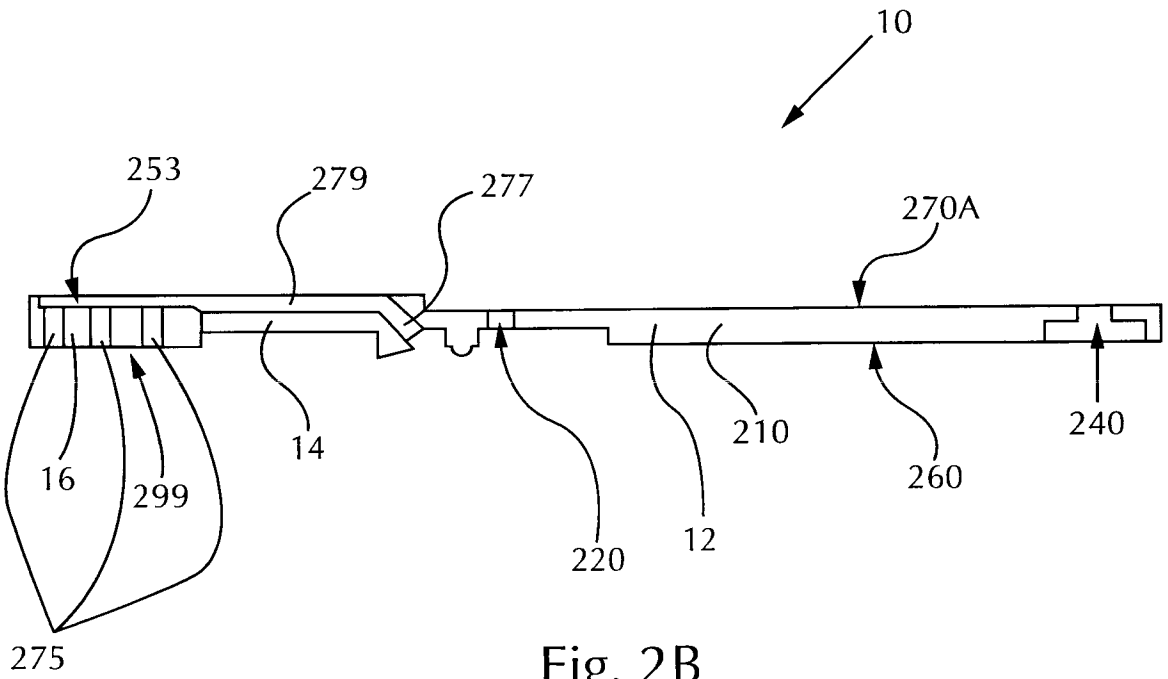
FIG. 2B is a partial cross sectional view of the toothbrush of FIG. 1 with some features removed for clarity, the cross section being along line 2-2.

Referring to FIGS. 2A and 2B, the base 210 may comprise a first aperture 220 and a second aperture 240. Additional apertures extending through the base 210 may be utilized. The apertures, e.g. 220 and 240 can allow the first grip member 20 to be unitarily formed with the second grip member 250. The second grip member 250 and the first grip member 20 may be attached to one another through the first aperture 220. Similarly, the identification symbol 50 may be unitarily formed with the second grip member 250 and attached thereto via the second aperture 240.

The base 210 may comprise a recess 277 in which the material for the collar 290 resides. The collar 290 may be unitarily formed with the first grip member 20. The neck 14 of the base 210 may comprise a channel 279 in which a strip of material 294 may be disposed. The strip of material 294 may connect the collar 290 with the tongue cleaner 292 in the head 16. The strip of material 294, the tongue cleaner 292 and the collar 290 may be unitarily formed.

Additionally, the base 210 in the oral engaging region 70 may comprise a plurality of indentations 275 on a side of the head 16. The indentations 275 can allow the material of the tongue cleaner 292 to flow one side of the head 16 to an opposite side of the head 16 and form the elastomeric elements 291 (shown in FIG. 2A) which extend from the elevated surface 299 of the head 16 of the toothbrush 10. In some embodiments, a plurality of elastomeric elements 291 may be unitarily formed with the tongue cleaner 292.

Still referring to FIGS. 2A and 2B, during processing, the material utilized for the second grip member 250 may be injection molded to the base 210. The injection molding operation can provide the material on a back surface 270A of the base 210 to form the second grip member 250. The material can flow through the first aperture 220 and the second aperture 240 thereby forming the first grip member 20 and the identification element 50. The material can then flow through the recess 277 thereby forming the collar 290. The material can flow through the channel 279 thereby forming the strip of material 294 and flow to the head 16 thereby forming the tongue cleaner 292. The material can flow through the indentations 275 to form the plurality of elastomeric elements 291.

For those embodiments comprising elastomeric elements which are disposed inboard of the periphery of the head 16, apertures may be provided in the head 16 thereby allowing the material utilized for the tongue cleaner 292 to flow through the head 16 thereby forming the plurality of elastomeric elements. Additionally, for those embodiments comprising both elastomeric elements 291 which are disposed about the periphery and elastomeric elements disposed inboard of the periphery, both the indentations and apertures may be utilized to form the elastomeric elements. Embodiments are contemplated where each of the plurality of elastomeric elements 291 is integral with one another and/or integral with the tongue cleaner 292. For those embodiments where the plurality of elastomeric elements 291 is disposed inboard of the periphery of the head 16, the plurality of elastomeric elements 291 may be integral with each other. Additionally, for such embodiments, the plurality of elastomeric elements 291 may be integral with the tongue cleaner 292. For example, the plurality of elastomeric elements 291 may extend through apertures in the head 16 and integrally extend from the tongue cleaner 292.

Uniquely, the flow of material across the base 210 may be from the back surface 270A to the front side surface 260 and then to the back surface 270A again. This configuration, can provide an elaborate appearance for the toothbrush 10 without the use of a third material for the handle 12, neck 14, and/or head 16. For example, this configuration allows there to be a separation on the back side facing surface 270 of the toothbrush 10 between the second grip member 250 and the collar 290. This separation can be aesthetically appealing. Moreover, the separation between the second grip member 250 and the collar 290 can provide some tactile sensation to the user. Since the collar 290 and the second grip member 250 are separated, a harder material may be provided in the separation between the collar 290 and the second grip member 250. The harder material can provide additional resistance to the second grip member 250 in the area of the separation as opposed to areas disposed away from the separation.

As described above, the second grip member 250, the first grip member 20, the identification element 50, the collar 290, the strip of material 294, the tongue cleaner 292, and/or the plurality of elastomeric elements 291 may be unitarily formed. However, in some embodiments, at least one of these, e.g. the second grip member 250, the first grip member 20, the identification element 50, the collar 290, the strip of material 294, the tongue cleaner 292, and/or the plurality of elastomeric elements 291, may be discretely formed and attached to the base 210. While more complicated during manufacturing, such embodiments allow for some flexibility in the material selection for these features.

Figure 3B:
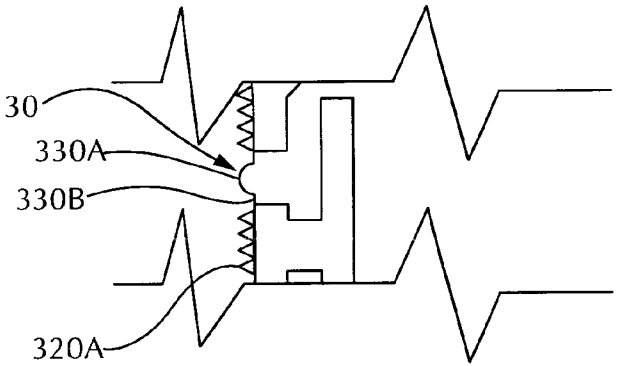
FIG. 3B is a close up view showing the partial cross section of FIG. 3A.
Figure 3A:
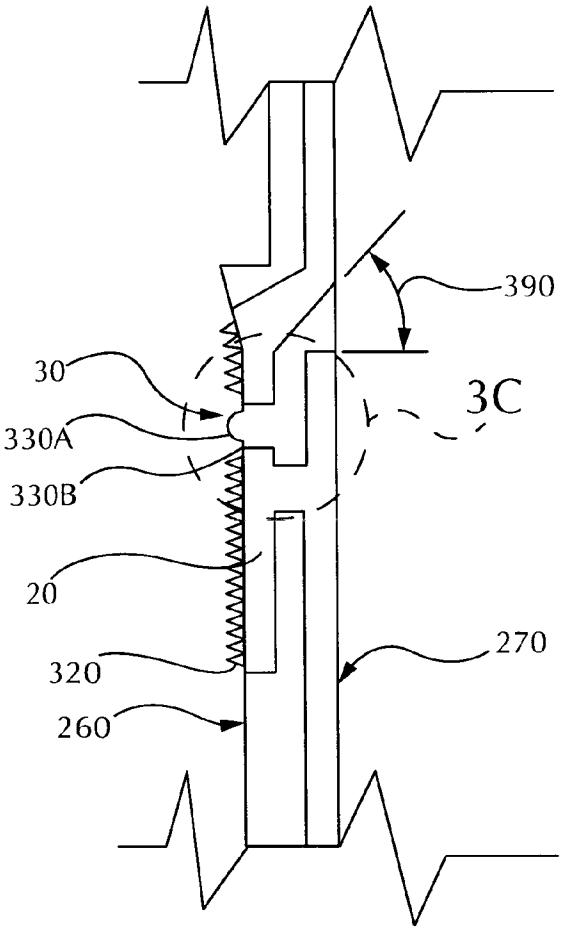
FIG. 3A is a close up view showing the partial cross section of FIG. 2A.
Figure 3C:
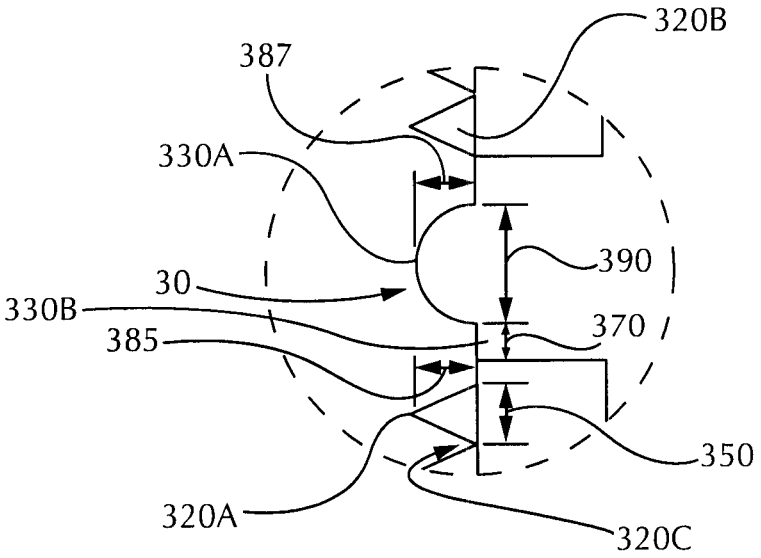
FIG. 3C is a close up view showing the partial cross section of FIG. 3B.

As shown in FIGS. 3A-3C, the first grip member 20 may comprise a plurality of grip elements 320. The gripping elements 320 may be configured as a plurality of tips 320A and valleys 320C. Each of the gripping elements 320 may comprise the tip 320A and a base portion 320B, and each base portion 320B and/or each adjacent gripping element 320 is separated by a valley 320C. The tips 320A may be separated by any suitable distance. Some examples of suitable distances include greater than about 0.5 mm, greater than about 1.0 mm, greater than about 1.5 mm, greater than about 2.0 mm, greater than about 2.5 mm, greater than about 3.0 mm, greater than about 3.5 mm, greater than about 4.0 mm, greater than about 4.5 mm, and/or less than about 5.0 mm, less than about 4.5 mm, less than about 4.0 mm, less than about 3.5 mm, less than about 3.0 mm, less than about 2.5 mm, less than about 2.0 mm, less than about 1.5 mm, less than about 1.0 mm, less than about 0.5 mm, less than about 0.25 mm, or any number or any range that is within values provided above. In some embodiments, the distance between peaks is about 1.6 mm. In some embodiments, the distance between tips 320A is about 1 mm at the bottom and 1.25 at the transition to the peak radius While in the FIGS. 3A-3C, the tips 320A are shown as comprising a pointed end, e.g. tapered, in some embodiments, the tips 320A of the grip elements 320 may have a radius. The radius can be between about 0.1 mm to about 0.3 mm or from about 0.15 mm to about 0.80 mm. The grip elements 320 having a rounded end can have any suitable radius. For example, the radius may be greater than about 0.05 mm, greater than about 0.10 mm, greater than about 0.15 mm, greater than about 0.2 mm, greater than about 0.3 mm, greater than about 0.4 mm, greater than about 0.5 mm, greater than about 0.6 mm, greater than about 0.7 mm, greater than about 0.8 mm, greater than about 0.90 mm, and/or less than about 0.9 mm, less than about 0.8 mm, less than about 0.7 mm, less than about 0.6 mm, less than about 0.5 mm, less than about 0.4 mm, less than about 0.3 mm, less than about 0.2 mm, or any number or any range within the values provided above.

In some embodiments, the grip elements 320 may comprise a combination of radii. For example, some grip elements 320 may comprise a tip 320A with a radius of about 0.15 mm while other grip elements comprise a tip 320A with a radius of about 0.7 mm. The grip elements having a smaller radius may be positioned nearer the distal end 80 (shown in FIG. 1) than the grip elements having a larger radius. Such embodiments, may provide a tactile cue to the user regarding proper thumb and/or finger placement. In some embodiments, the grip elements may comprise tips having graduated radii which increase toward the proximal end 90 (shown in FIG. 1) of the toothbrush.

In some embodiments, the grip elements 320 may comprise a combination of tips 320A. For example, some of the grip elements 320 may comprise a tapered tip while other grip elements 320 comprise a rounded tip. In some embodiments, grip elements 320 having a combination of radii may be utilized in conjunction with grip elements 320 having tapered tips.

The valleys 320C may serve as the spaces between adjacent grip elements 320. The valleys 320C may be any suitable distance. Some examples of suitable distances include greater than about 0.5 mm, greater than about 1.0 mm, greater than about 1.5 mm, greater than about 2.0 mm, greater than about 2.5 mm, greater than about 3.0 mm, greater than about 3.5 mm, greater than about 4.0 mm, greater than about 4.5 mm, and/or less than about 5.0 mm, less than about 4.5 mm, less than about 4.0 mm, less than about 3.5 mm, less than about 3.0 mm, less than about 2.5 mm, less than about 2.0 mm, less than about 1.5 mm, less than about 1.0 mm, less than about 0.5 mm, less than about 0.25 mm, or any number or any range that is within values provided above.

The base portions 320B of the grip elements 320 may have a base length 350 of between about 0.5 mm and 1.0 mm. The base length 350 may be any suitable distance. Some examples of suitable distances include greater than about 0.3 mm, greater than about 1.0 mm, greater than about 1.5 mm, greater than about 2.0 mm, greater than about 2.5 mm, greater than about 3.0 mm, and/or less than about 3.0 mm, less than about 2.5 mm, less than about 2.0 mm, less than about 1.5 mm, less than about 1.0 mm, less than about 0.5 mm, less than about 0.25 mm, or any number or any range that is within values provided above.

The grip elements 320 may have a height 385 of about 0.8 mm. Any suitable height 385 may be utilized. Some examples include greater than about 0.3 mm, greater than about 1.0 mm, greater than about 1.5 mm, greater than about 2.0 mm, greater than about 2.5 mm, greater than about 3.0 mm, greater than about 3.5 mm, greater than about 4.0 mm, and/or less than about 4.0 mm, less than about 3.5 mm, less than about 3.0 mm, less than about 2.5 mm, less than about 2.0 mm, less than about 1.5 mm, less than about 1.0 mm, less than about 0.5 mm, or any number or any range that is within values provided above. In some embodiments, a suitable height 385 range is between about 0.8 mm and 1.5 mm.

In general, the height 385 and base length 350 can be in a ratio of about 2 to 1. The ratio, in some embodiments can be about 2.5 to 1. In some embodiments, the ratio can be less than about 3 to 1 where the height 385 is less than 3 of the base length 350. It is believed that by increasing the ratio, problems with injection molding of the gripping elements 320 could result. For example, for ratios which are larger than 3 to 1 material for the gripping element 320 will have to travel a longer distance to create the height 385. The longer distance can create a potential for cooling of the material prior to it reaching its final destination. In order to overcome this cooling off, increased temperature and/or pressure may be utilized; however, such an increase in temperature and pressure may detrimentally impact the molds in which the gripping elements are formed. For example, the valleys 320C between adjacent grip elements 320 should have a minimum distance of from about 0.6 mm to about 0.8 mm. Note that the valleys 320C, in the present embodiment are formed by walls in a mold cavity and as such, the distance of the valleys 320C can represent the wall thickness of the mold cavity. Increased temperature and pressure may require an increase for the distance for the valleys 320C to ensure mold integrity and longevity. It is believed that the smaller the distance for the valleys 320C will cause thinner walls in the mold cavity which are more susceptible to damage via the temperature and/or pressure.

An additional issue is that the increased height 385 can lead to de-molding problems. For example, if the height 385 of the gripping element 320 is too great, with the utilization of a soft material, e.g. TPE etc., the grip element can stick in the mold while releasing the mold halves.

This could result in an undesired elongation of the gripping elements. To overcome this issue a venting hole in the mold cavity may be utilized having a diameter of about 0.05 mm to about 0.08 mm. In some embodiments, the vent hole is less than or equal to about 0.1 mm. The venting hole should be thinner than the width of the tip 320A within the mold cavity in order to reduce the likelihood of leakage through the venting hole.

In some embodiments, the gripping elements 320 are designed having a draft angle of greater than about 0.5 degrees, greater than about 1.0 degrees, greater than about 1.5 degrees, greater than about 2.0 degrees, greater than about 2.5 degrees, greater than about 3.0 degrees, and/or less than about 3.0 degrees, less than about 2.5 degrees, less than about 2.0 degrees, less than about 1.5 degrees, less than about 1.0 degrees, or any number or any range within the values provided above. The draft angle is the angle of taper between the base 320B and the tip 320A.

The height 385 may be selected such that the gripping elements 320 and the front side surface 260 (shown in FIG. 2A) are coplanar. In some embodiments, the height 385 may be configured such that the gripping elements 320 are higher than the front side surface 260. In some embodiments, the height 385 may be configured such that the gripping elements 320 are lower than the front facing surface 260.

The guidance element 30 may comprise a protrusion 330A and a ring 330B. The protrusion 330A may comprise a diameter 390 of about 1.5 mm. However, the diameter 390 may be any suitable distance. Some examples of suitable distances include those greater than about 1.5 mm, greater than about 2.0 mm, greater than about 2.5 mm, greater than about 3.0 mm, greater than about 3.5 mm, greater than about 4.0 mm, greater than about 4.5 mm, and/or less than about 5.0 mm, less than about 4.5 mm, less than about 4.0 mm, less than about 3.5 mm, less than about 3.0 mm, less than about 2.5 mm, less than about 2.0 mm, less than about 1.5 mm, or any number or any range that is within values provided above. Additionally, while diameter 390 is discussed, the protrusion 330A may comprise any suitable cross section. For example, the protrusion 330A may comprise a polygonal cross section, an ovoid cross section, etc. In such embodiments, the protrusion 330A may be oriented in a particular configuration to provide a tactile cue to the user.

The protrusion 330A may have a height 387 which can be about 1.5 mm. Any suitable height 387 can be utilized. Some examples of suitable heights 387 include those greater than about 0.3 mm, greater than about 1.0 mm, greater than about 1.5 mm, greater than about 2.0 mm, greater than about 2.5 mm, greater than about 3.0 mm, greater than about 3.5 mm, greater than about 4.0 mm, greater than about 4.5 mm, and/or less than about 5.0 mm, less than about 4.5 mm, less than about 4.0 mm, less than about 3.5 mm, less than about 3.0 mm, less than about 2.5 mm, less than about 2.0 mm, less than about 1.5 mm, less than about 1.0 mm, less than about 0.5 mm, less than about 0.4 mm, or any number or any range that is within values provided above.

The protrusion 330A height 387 may be greater than the height 385 of the gripping elements 320. In some embodiments, the height 387 may be the same as the height 385. In some embodiments, the height 387 may be less than the height 385. Yet, in some embodiments, the height 387 may be the same as height 385 wherein the protrusion 330A, the gripping elements 320 and the front side surface 360 are all coplanar.

The ring 330B may surround the protrusion 330A. The ring 330B may comprise any suitable thickness 370. Some examples of suitable thicknesses 370 for the ring 330B include greater than about 0.3 mm, greater than about 0.4 mm, greater than about 0.5 mm, greater than about 0.6 mm, and/or less than about 0.6 mm, less than about 0.5 mm, less than about 0.4 mm, less than about 0.35 mm, or any number or any range that is within the values provided above.

It has been discovered that the inclusion of the ring 330B provides an increase in quality with regard to the guidance element 30. Where the ring 330B is absent, it was found that material from the first grip member 20 often bled through molds such that a film was formed on the guidance element 30.

As the guidance element 30 and the first grip member 20 can be of differing materials, e.g. hard and soft, a soft film on the harder material of the guidance element 30 may not be desirable. Without wishing to be bound by theory, it is believed that the presence of the ring 330B allows a mold cavity surface to interface with the ring 330B on a two dimensional basis. Additionally, depending on the thickness of the ring 330B, the interface between the mold cavity surface and the ring 330B may be increased to reduce the likelihood of leakage even more. In contrast, where the ring 330B is absent, a corresponding mold cavity surface interfaces with the guidance element 30 in order to provide the sealing function. Because the guidance element 30 is a three dimensional structure, the complexity of the corresponding mold cavity, in order to provide proper sealing, is increased. Additionally, where there is no ring 330B, the mold cavity may have to engage an infinitesimal number of points on the guidance element 30 to provide the proper sealing. As such, the ring 330B can provide a more aesthetically appealing and tactile appealing guidance element 30.

Figure 4:
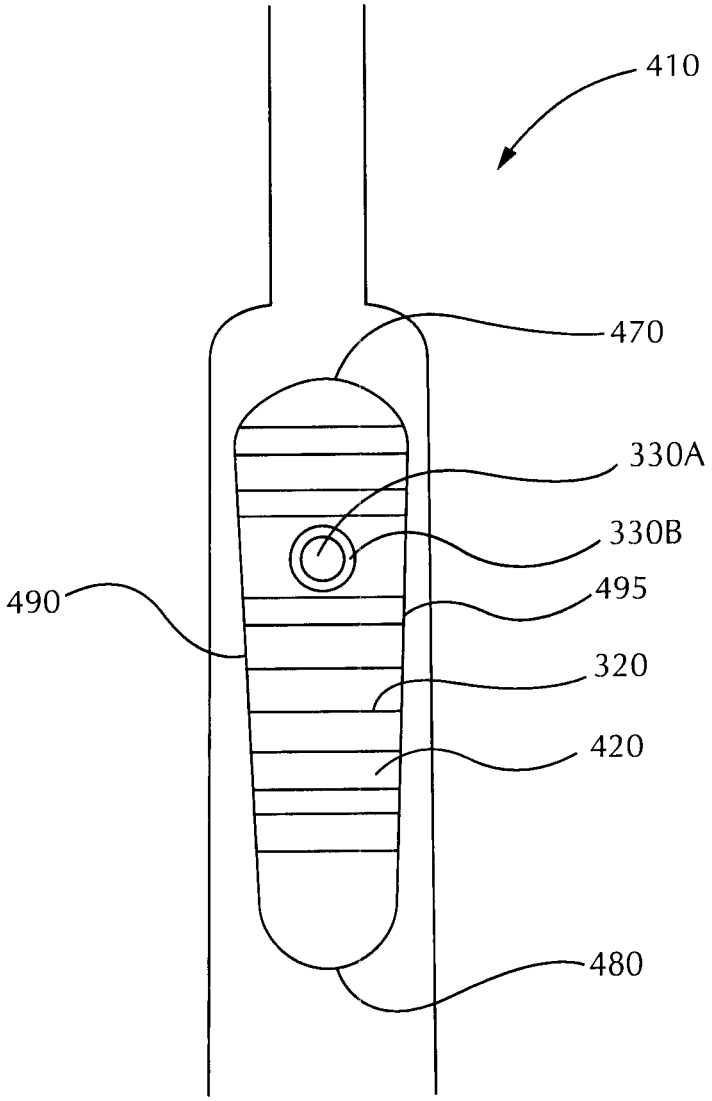
FIG. 4 is a front view showing a toothbrush constructed in accordance with another embodiment of the present invention.

As shown in FIG. 4, a first grip member 420 may comprise any suitable shape. As shown previously, the first grip member 20 (see FIG. 1) was shown as a rectangular structure. However, the first grip member 420 may be configured to more closely resemble a thumb print.

For example, the first grip member 420 may comprise a rounded top edge 470 and/or a rounded bottom edge 480. Sides 490 and 495 of the first grip member 420 may taper toward the rounded top edge 470 or may taper toward the rounded bottom edge 480. In some embodiments, the sides 490 and 495 may taper toward a midpoint between the rounded top edge 470 and the rounded bottom edge 480.

Figure 5A:
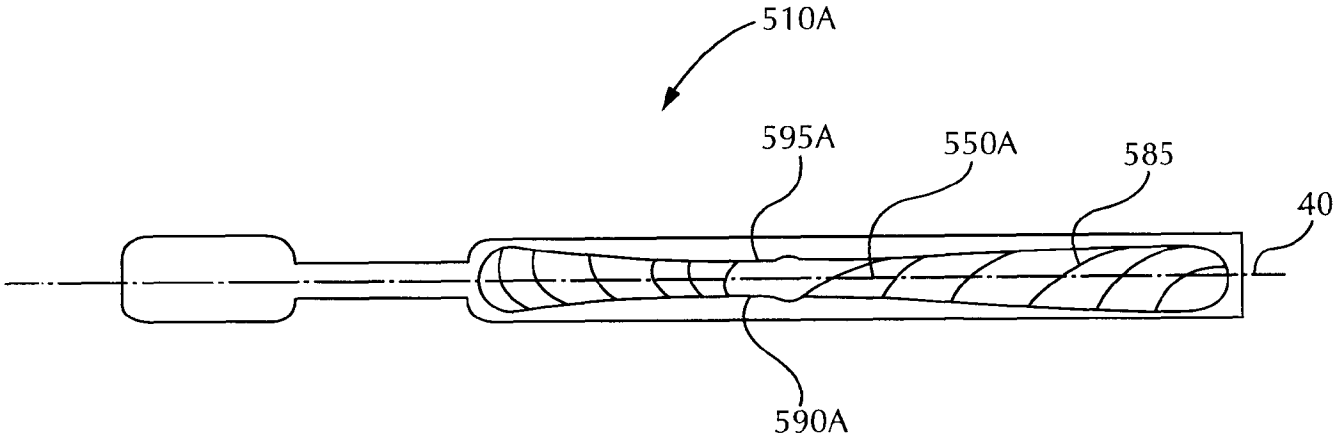
FIG. 5A is a back view showing a toothbrush constructed in accordance with another embodiment of the present invention.
Figure 5B:
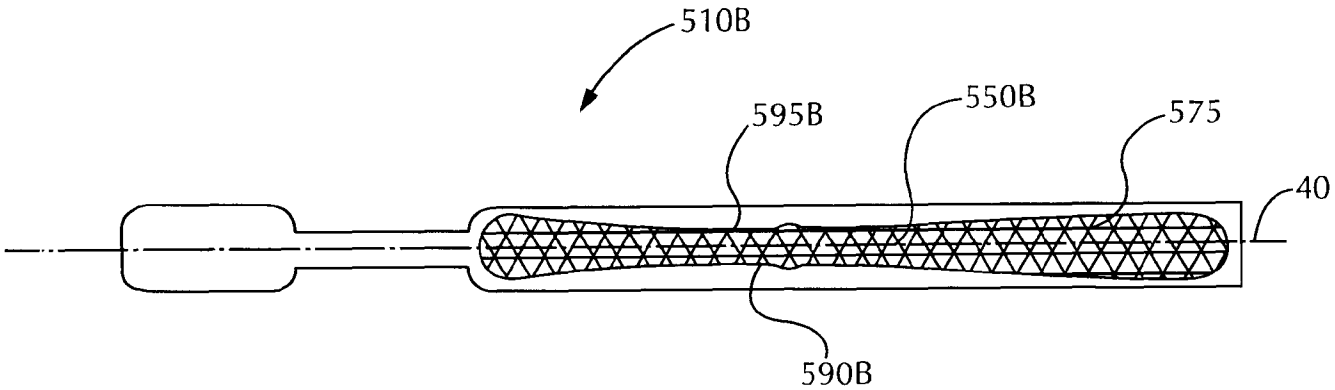
FIG. 5B is a back view showing a toothbrush constructed in accordance with another embodiment of the present invention.

Additionally, the gripping elements 320 may intersect the sides 490 and 495. In embodiments where the sides 490 and 495 taper toward the rounded bottom edge 480, the gripping elements 320 may progressively become shorter the closer the gripping element 320 to the rounded bottom edge 480. Similarly, in such embodiments, the gripping elements 320 may progressively become larger the closer the gripping element to the rounded top edge 470. The converse is contemplated for tapered sides toward the rounded top edge 470. For those embodiments where the sides 490 and 495 are tapered at a midpoint between the rounded top edge 470 and the rounded bottom edge 480, the gripping elements 320 may become shorter toward the tapered area of the sides 490, 495. The second grip member 250 (shown in FIG. 2A) may comprise gripping elements similar to those discussed heretofore. As shown in FIGS. 5A and 5B, the gripping elements may be symmetrical with respect to the longitudinal axis 40 or asymmetrical. For example, with regard to FIG. 5A, a toothbrush 510A may comprise a second grip member 550A having a plurality of gripping elements 585. Each of the gripping elements 585 may extend from one side 590A to another side 595A of the second grip member 550A. Additionally, each of the gripping elements 585 may be configured such that they have a variety of curvature. For example, one particular gripping element 585 may be arcuate and include a plurality of radii of curvature and/or adjacent gripping elements may comprise varied radii. Additionally, spacing between adjacent gripping elements 585 may be varied as well. For example, near a taper in the second grip member 550A, spacing between the gripping elements 585 may be less than that between the gripping elements 585 in a non-tapered area of the second grip member 550A. Additionally, near a proper location for the forefinger, the gripping elements 585 may have varied curvature, varied spacing, varied height, and/or varied orientation in order to provide a tactile cue to the user with regard to the proper placement of the forefinger on the second grip member 550A.

In another embodiment, a toothbrush 510B may comprise a second grip member 550B having a plurality of gripping elements 575. As shown, the gripping elements 575 of the second grip member 550B may extend from one side 590B to another side 595B of the second grip member 550B. The gripping elements 575 may intersect with one another and form a uniform pattern along at least a portion of the second grip member 550B. At the appropriate location for the forefinger of the user, the gripping elements 575 may be spaced differently, may have a differing height, may have a differing pattern, and/or the like, in order to provide a tactile cue to the user regarding the proper placement of the user's forefinger.

The gripping elements 575 and 585 may be configured similar to the gripping elements 320 discussed heretofore. Suitable heights for the gripping elements 575 and 585 can be between about 0.1 mm to about 0.5 mm.

Figure 6:
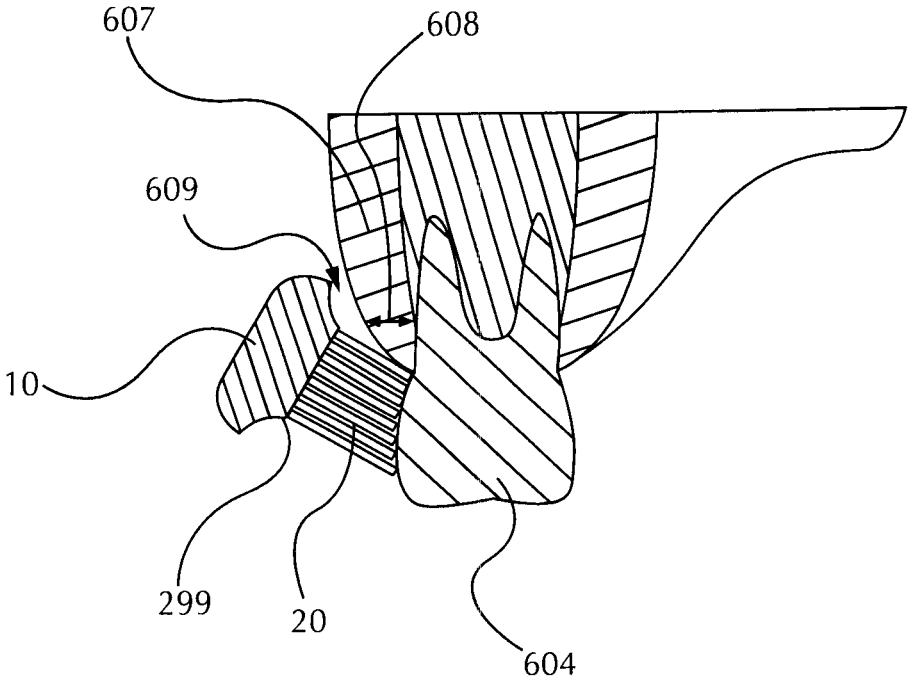
FIG. 6 is a representative view showing the toothbrush of FIG. 1 within a partial oral cavity.

As discussed previously, the head 16, shown in FIG. 1 may comprise the elevated surface 299. As shown in FIG. 6, the elevated surface 299 can provide better reach of the cleaning elements 20 to the tooth surface. In general, gums 607 of a user can vary in thickness 608. This varying thickness 608 can define a distance between the brush 10 and a tooth 604. It is believed that because of the elevated surface 299, the contact elements 20 have better access to the teeth 604. As shown, a gap 609 between the brush 10 and the gums 607 may be present; however, because the brush 10 includes an elevated surface 299, a corner nearest the gap 609 is absent. The absence of this corner allows closer positioning of the cleaning elements 20 to the teeth 604. In contrast, conventional toothbrushes can include a rounded corner near the gap which can affect distance of the gap between the brush and the gums.

Figure 7:
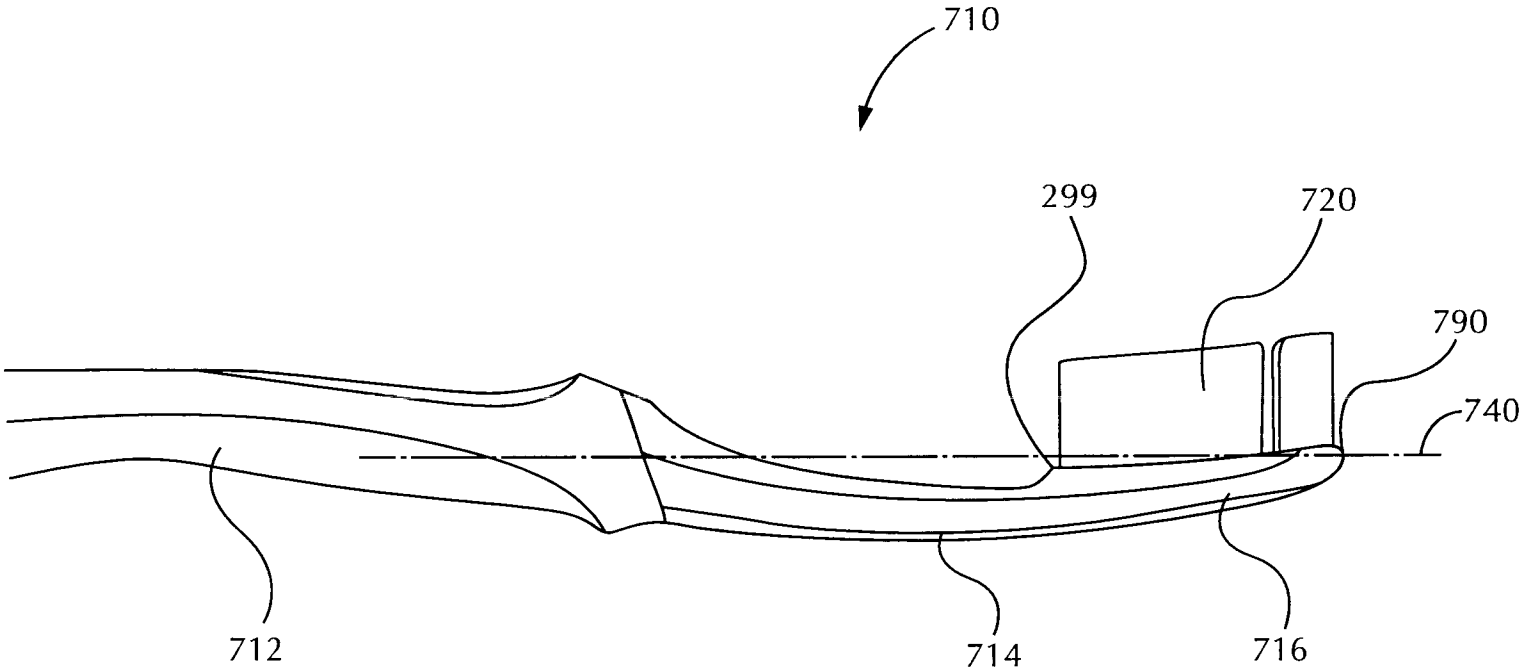
FIG. 7 is a side view showing a portion of a toothbrush constructed in accordance with another embodiment of the present invention.

Additionally, the neck of the toothbrush can be configured to provide additional benefits to the user. As shown in FIG. 7, a toothbrush 710 having a handle 712, a head 716, and a neck extending between the handle 712 and the head 716 is constructed in accordance with the present invention. A longitudinal axis 740 extends through the toothbrush 710 and through the elevated surface 299 adjacent a proximal end 790 of the toothbrush 710. The elevated surface 299 can be generally aligned with the longitudinal axis 740 of the toothbrush 710 or positioned at a slight angle thereto. Additionally, the longitudinal axis 740 can be aligned with a rotational axis of the toothbrush 710. In such embodiments, it is believed that the alignment of the elevated surface 299 with the longitudinal axis 740 can reduce the likelihood of wobbling in the mouth.

Still referring to FIG. 7, the neck 714 may be bent, curved, etc. As shown, the neck 714 near the interface with the handle 712 intersects the longitudinal axis 740. As the neck 714 progresses toward the head 716, the neck 714 may curve away from the longitudinal axis 740. As shown, the neck 714 is concave with respect to the longitudinal axis 740. Near the head 716, the neck 714 begins to rise toward the longitudinal axis 740. In some embodiments, depending on the curvature of the neck 714, the elevated surface 299 and/or cleaning elements 720 extending therefrom, may be positioned at a slight angle with respect to the longitudinal axis 740.

This configuration of the contact elements 720 is believed to provide a benefit for interdental cleaning.

Any suitable materials may be utilized for the oral care implement described herein. For example, the base 210 (shown in FIGS. 2A and 2B) may comprise polyethylene (PE), polypropylene (PP), polyethyleneterapthalate (PET), acrylonitrile-butadiene-styrene (ABS), styrene-acrylonitrile (SAN), PP and thermoplastic elastomer (TPE) blends, acetal (POM), nylon (PA), modified polyphenylene oxid (PPO), polyester (PBT), polycarbonate (PC), high impact polystyrene (HIPS), isoplast and other thermoplastic urethane (TPU) materials, the like, and suitable combinations thereof.

The first grip member 20, 420; the second grip member 250, 550A, and/or 550B; the collar 290; the strip of material 294; the tongue cleaner 292; and/or the elastomeric elements 291; may comprise any suitable thermoplastic elastomer. Some suitable examples, include SEBS (styrene-ethylene-butylene-styrene block copolymer) or thermoplastic polyurethane. In some embodiments, the material utilized in the first grip member 20, 420; the second grip member 250, 550A, and/or 550B; the collar 290; the strip of material 294; the tongue cleaner 292; and/or the elastomeric elements 291; may be selected to provide a specific benefit for the user. For example, the material selected in the first grip member 20, 420 may be softer than the material utilized in the plurality of elastomeric elements 291. In other examples, additives may be included in the material utilized for the first grip member 20, 420; the second grip member 250, 550A, and/or 550B; the collar 290; the strip of material 294; the tongue cleaner 292; and/or the elastomeric elements 291. In some embodiments, additives may be added to provide an aesthetic appeal to the material. As an example, glitter may be added to the material.

Additionally, as used herein, the term "contact elements" is used to refer to any suitable element which can be inserted into the oral cavity. Some suitable elements include bristle tufts, elastomeric massage elements, elastomeric cleaning elements, massage elements, tongue cleaners, soft tissue cleaners, hard surface cleaners, combinations thereof, and the like. The head may comprise a variety of cleaning elements. For example, the head may comprise bristles, abrasive elastomeric elements, elastomeric elements in a particular orientation or arrangement, e.g. pivoting fins, prophy cups, or the like. Some suitable examples of elastomeric cleaning elements and/or massaging elements are described in U.S. Patent Application Publication Nos. 2007/0251040; 2004/0154112; 2006/0272112; and in U.S. Pat. Nos. 6,553,604; 6,151,745. The cleaning elements may be tapered, notched, crimped, dimpled, or the like. Some suitable examples of these cleaning elements and/or massaging elements are described in U.S. Pat. Nos. 6,151,745; 6,058,541; 5,268,005; 5,313,909; 4,802,255; 6,018,840; 5,836,769; 5,722,106; 6,475,553; and U.S. Patent Application Publication No. 2006/0080794.

For those embodiments which include an elastomeric element on a first side of the head and an elastomeric element on a second side of the head (opposite the first), the elastomeric elements may be integrally formed via channels or gaps which extend through the material of the head. These channels or gaps can allow elastomeric material to flow through the head during an injection molding process such that both the elastomeric elements of the first side and the second side may be formed in one injection molding step.

In some embodiments, the contact elements may comprise tufts. The tufts may comprise a plurality of individual filaments which are securely attached to a cleaning element carrier. Such filaments may be polymeric and may include polyamide or polyester. The longitudinal and cross sectional dimensions of the filaments of the invention and the profile of the filament ends can vary. Additionally, the stiffness, resiliency and shape of the filament end can vary. Some examples of suitable dimensions include a length between about 3 cm to about 6 cm, or any individual number within the range. Additionally, the filaments may include a substantially uniform cross-sectional dimension of between about 100 to about 350 microns, or any individual number within the range. The tips of the filaments may be any suitable shape, examples of which include a smooth tip, a rounded tip, a pointed tip (tapered), and/or flagged tip. Additionally, embodiments are contemplated where a single tuft includes a combination of different tufts, e.g. tapered and rounded, tapered and flagged, etc. In some embodiments, the filaments may include a dye which indicates wear of the filaments as described in U.S. Pat. No. 4,802,255. Some examples of suitable filaments for use with the brush of the present invention are described in U.S. Pat. No. 6,199,242. In some embodiments, the cleaning elements may comprise fins as described heretofore. For example, in some embodiments, the cleaning element fields may comprise a combination of fins and tufts.

The contact elements may be attached to the head in any suitable manner. Conventional methods include stapling, anchor free tufting, and injection mold tufting. For those cleaning elements that comprise an elastomer, these elements may be formed integral with one another, e.g. having an integral base portion and extending outward therefrom.

The present invention may be utilized in manual toothbrushes where the cleaning motion is supplied completely by a user. However, embodiments are contemplated where the present invention comprises a manual toothbrush which supplements the user's motions with a vibration device as described in U.S. Patent Application Publication No. 2003/0162145. Moreover, embodiments are contemplated where the present invention includes a power toothbrush. A power toothbrush is one where the toothbrush provides the majority of the cleaning motion. The user may manipulate the power toothbrush to ensure that the power toothbrush contacts the desired oral surfaces. In such embodiments, the contact elements may be driven in a variety of motions. Some examples of such suitable motions are described in U.S. Patent Application Publication No. 2003/0084527. Also, embodiments are contemplated where the present invention includes a replaceable brush head for a power and/or a manual toothbrush.

The various features of the embodiments described herein may be utilized in other embodiments. For example, the neck 714 may be utilized in the toothbrush 10, 410, 510A, and 510B. As another example, the elevated surface 299 may be utilized in any embodiment described herein. As further examples, the protrusion 30, the first grip member 20, 420, second grip member 250, 550A, and/or 550B; the collar 290; the strip of material 294; the tongue cleaner 292; and/or the elastomeric elements 291; may be utilized in any of the embodiments described herein.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An oral care implement comprising:

a base with a gripping region and an oral engaging region, the base having an aperture extending therethrough; and a first grip member at least partially overlying the gripping region of the base and provided with at least one opening exposing a guidance element, wherein the first grip member comprises a plurality of gripping elements, and wherein the guidance element comprises a protrusion and a ring surrounding the protrusion, wherein the guidance element comprises a first material and the first grip member comprises a second material, wherein the first material is harder than the second material, wherein the protrusion of the guidance element has a height that is greater than a height of the ring surrounding the protrusion, and wherein the ring surrounding the protrusion is adjacent to the first grip member and has a thickness greater than 0.3 mm and less than 0.6 mm 2. The oral care implement of claim 1, wherein the gripping elements and the protrusion are the same height.

3. The oral care implement of claim 1, wherein the base comprises a recess and wherein the first grip member is disposed within the recess.

4. The oral care implement of claim 1, further comprising a second grip member in the gripping region and being unitary with the first grip member.

5. The oral care implement of claim 1, further comprising a second grip member disposed in the gripping region, wherein the second grip member is attached to the first grip member through the aperture.

6. The oral care implement of claim 5, further comprising an identification symbol, the identification symbol being unitary with the second grip member and attached thereto through the second aperture.

7. The oral care implement of claim 1, wherein the base comprises a second aperture.

8. The oral care implement of claim 1, wherein the base comprises a neck and a head attached to the neck, wherein a collar surrounds the neck and is unitary with the first grip member.

9. The oral care implement of claim 8, wherein the collar is inclined with respect to a longitudinal axis by about 15 degrees.

10. The oral care implement of claim 8, wherein the base further comprises a channel extending along the neck, a strip of material being disposed in the neck.

11. The oral care implement of claim 10, wherein the strip of material is unitary with the collar.

12. The oral care implement of claim 8, further comprising a tongue cleaner disposed on a backside of the head.

13. The oral care implement of claim 12, wherein the tongue cleaner is unitary with a strip of material which is unitary with the collar.

14. The oral care implement of claim 13, wherein the backside of the head comprises a recess, and wherein the tongue cleaner is disposed within the recess.

15. The oral care implement of claim 12, further comprising a plurality of contact elements, the contact elements being unitary with the tongue cleaner.

* * * * *